US011091935B2

(12) United States Patent
Diaz et al.

(10) Patent No.: US 11,091,935 B2
(45) Date of Patent: Aug. 17, 2021

(54) LOCKING PIECE ASSEMBLY FOR LATCH BOLTS

(71) Applicant: Sargent Manufacturing Company, New Haven, CT (US)

(72) Inventors: David Martinez Diaz, Tlaquepaque (MX); Fernando Meza Sanchez Tagle, Tlajomulco (MX)

(73) Assignee: Sargent Manufacturing Company, New Haven, CT (US)

( * ) Notice: Subject to any disclaimer, the term of this patent is extended or adjusted under 35 U.S.C. 154(b) by 808 days.

(21) Appl. No.: 15/788,941

(22) Filed: Oct. 20, 2017

(65) Prior Publication Data

US 2018/0119454 A1 May 3, 2018

Related U.S. Application Data

(60) Provisional application No. 62/414,039, filed on Oct. 28, 2016.

(51) Int. Cl.

| | |
|---|---|
| ***E05B 55/00*** | (2006.01) |
| ***E05B 35/00*** | (2006.01) |
| ***E05C 3/12*** | (2006.01) |
| ***E05B 17/00*** | (2006.01) |

(Continued)

(52) U.S. Cl.

CPC ..... *E05B 55/005* (2013.01); *E05B 17/0004* (2013.01); *E05B 35/008* (2013.01); *E05C 3/124* (2013.01); *E05B 65/02* (2013.01); *E05C 3/162* (2013.01)

(58) Field of Classification Search

CPC ..... E05B 55/005; E05B 13/108; E05B 63/16; E05B 13/002; E05B 37/163; E05B 3/003; Y10T 292/0986; Y10T 70/5832; Y10T 292/57; Y10T 292/93; Y10T 292/0982; Y10T 70/542; Y10T 70/7638; E05C 1/163; Y10S 292/37

See application file for complete search history.

(56) References Cited

U.S. PATENT DOCUMENTS 2,693,692 A * 11/1954 Erkkila ..... E05B 55/005 70/474
2,719,424 A * 10/1955 Rayburn ..... E05B 55/005 70/224

(Continued)

*Primary Examiner* — Mark A Williams
(74) *Attorney, Agent, or Firm* — DeLio Peterson & Curcio LLC; Brian G. Schlosser; Peter W. Peterson

(57) ABSTRACT

A locking piece assembly adapted for installation in a cylindrical lock and meant to engage a locking mechanism comprises a locking piece and a lock button. The locking piece has one end adapted to engage the locking mechanism and an opposite end with a connecting hook. The lock button has an aperture adapted for attachment to the locking piece connecting hook, and can be depressed to move the locking piece inward to engage the locking mechanism after the locking piece assembly is installed in the cylindrical lock. The lock button can be installed onto the locking piece by hand, specifically by inserting the connecting hook into the aperture on the lock button, pivoting the lock button with respect to the locking piece, and placing the locking piece and lock button into alignment. After installation, the connecting hook is held in place to prevent separation from the lock button aperture.

10 Claims, 7 Drawing Sheets

(51) Int. Cl.
*E05B 65/02* (2006.01)
*E05C 3/16* (2006.01)

(56) References Cited

U.S. PATENT DOCUMENTS 2,841,432 A * 7/1958 Ahlquist ..... E05C 1/163
292/169.18
2,983,134 A * 5/1961 Russell ..... E05B 41/00
70/153
3,916,656 A * 11/1975 Schlage ..... E05B 55/005
70/478
5,598,726 A * 2/1997 Cordle ..... E05B 55/005
292/336.3
5,794,472 A * 8/1998 Kester ..... E05B 13/108
292/DIG. 27
6,623,053 B1 * 9/2003 Hwang ..... E05B 55/005
292/336.3
9,982,455 B2 * 5/2018 Badhya ..... E05B 55/005

* cited by examiner

LOCKING PIECE ASSEMBLY FOR LATCH BOLTS

BACKGROUND OF THE INVENTION

1. Field of the Invention

The present invention relates to locking device assemblies commonly used in latch bolt structures and, more particularly, to a lock assembly which is simpler and cheaper to assemble by eliminating extraneous parts and the need for a machine.

2. Description of Related Art

Current lock assemblies are typically composed of many pieces that must be machined together to create a complete locking mechanism. Due to the high number of separate parts needed to assemble such locks, manufacturing is a long and tedious process which typically requires machine assistance. Additionally, the price of manufacturing these lock assemblies are expensive.

SUMMARY OF THE INVENTION

Bearing in mind the problems and deficiencies of the prior art, it is therefore an object of the present invention to provide a lock and method of assembly for a latch bolt mechanism that requires a minimal number of parts.

Another object of the present invention is to provide a lock and method of assembly for a latch bolt mechanism that is inexpensive.

A further object of the present invention is to provide a lock and method of assembly for a latch bolt mechanism that may be done without the aid of a machine.

Still other objects and advantages of the invention will in part be obvious and will in part be apparent from the specification.

The above and other objects, which will be apparent to those skilled in the art, are achieved in the present invention which is directed to a locking piece assembly adapted for installation in a cylindrical lock to engage a locking mechanism upon being moved. The locking piece assembly comprises a locking piece and a lock button. The locking piece has one end adapted to engage the locking mechanism, and an opposite end with a connecting hook. The lock button has an aperture adapted to be attached to the locking piece connecting hook, the lock button being able to be depressed to move the locking piece inward to engage and lock the locking mechanism after installation in the cylindrical lock. The lock button may be attached by hand onto the locking piece by inserting the connecting hook into the aperture on the lock button, pivoting the button with respect to the locking piece, and placing the locking piece and button into alignment.

In an embodiment, the connecting hook is held in place to restrict separation from the lock button aperture following installation in the cylindrical lock. The locking piece connecting hook may comprise a hook end extending generally perpendicularly to a longitudinal axis of the cylindrical lock and a hook projection extending in a direction opposite the hook end, and wherein after attachment to the lock button the hook end and the hook projection are held in place within the lock button aperture. The locking piece may be held in place, permitting rotational movement of the lock button around the connecting hook after installation of the attached locking piece and lock button into the lock assembly. The locking piece may further be elongated, and after attachment to the lock button, is in longitudinal alignment therewith.

The present invention may further be directed to a cylindrical lock comprising a locking mechanism, a locking piece, and a lock button. The locking piece has one end engaging the locking mechanism, and an opposite end having a connecting hook. The lock button extends from a knob of the cylindrical lock and has an aperture at an inward end thereof. The locking piece connecting hook is attached to the lock button aperture, the lock button being able to move the locking piece to engage and lock the locking mechanism.

In an embodiment, the connecting hook is held in place to restrict separation from the lock button aperture. The locking piece connecting hook may comprise a hook end extending generally perpendicularly to a longitudinal axis of the cylindrical lock and a hook projection extending in a direction opposite the hook end, the hook end and the hook projection being held in place within the lock button aperture. The locking piece may further be elongated, and in longitudinal alignment with the lock button.

The present invention may also be directed to a method of making a lock piece assembly, providing a locking piece, and a lock button. The locking piece has one end adapted to engage the locking mechanism, and an opposite end having a connecting hook. The lock button has an aperture adapted to be attached to the locking piece connecting hook, the lock button being able to be depressed to move the locking piece inward to engage and lock the locking mechanism after assembly. The method includes attaching the lock button to the locking piece by inserting the connecting hook into the aperture on the lock button, and placing the locking piece and button into alignment.

In an embodiment, the method may further include pivoting the button with respect to the locking piece after inserting the connecting hook into the lock button aperture and before placing the locking piece and button into alignment. The locking piece connecting hook may comprise a hook end extending generally perpendicularly to a longitudinal axis of the cylindrical lock and a hook projection extending in a direction opposite the hook end, and wherein after attachment the hook end and the hook projection are held in place within the lock button aperture. The locking piece connecting hook may comprise a hook end extending generally perpendicularly to the locking piece longitudinal axis and a hook projection extending in a direction opposite the hook end. During assembly the connecting hook is inserted into the connecting aperture with the longitudinal axis of the button at an angle with the longitudinal axis of the locking piece. An outward end of the button is pivoted with respect to the locking piece so that the angle between the button axis and locking piece axis decreases, until an inward side of the hook projection contacts an edge of the button aperture, and the lock button and, locking piece are moved into longitudinal alignment, and after assembly the hook end and the hook projection are held in place within the lock button aperture. The button aperture may be sized such that there is an interference when the hook projection is pivoted to contact the edge of the button aperture and during installation the hook projection moves beyond the aperture edge and snaps into place within the button aperture. The locking piece may be elongated, and after attachment to the lock button, is in longitudinal alignment therewith.

The present invention may still further be directed to a method of manufacturing a cylindrical lock having a locking mechanism by initially providing a locking piece and a lock button. The locking piece has one end adapted to engage the locking mechanism, and an opposite end having a connecting hook. The lock button has an aperture adapted to be attached to the locking piece connecting hook, the lock button being able to be depressed to move the locking piece inward to engage and lock the locking mechanism after assembly. The method includes attaching the lock button to the locking piece by inserting the connecting hook into the aperture on the lock button, and placing the locking piece and button into alignment to make a locking piece assembly. The locking piece assembly is then installed into the cylindrical lock whereby the lock button extends from a knob of the cylindrical lock and the locking piece one end engages a locking mechanism of the cylindrical lock, the lock button being able to move the locking piece to engage and lock the locking mechanism.

In an embodiment the method further includes pivoting the button with respect to the locking piece after inserting the connecting hook into the lock button aperture and before placing the locking piece and button into alignment. The locking piece connecting hook may comprise a hook end extending generally perpendicularly to a longitudinal axis of the cylindrical lock and a hook projection extending in a direction opposite the hook end, and wherein after attachment the hook end and the hook projection are held in place within the lock button aperture. The locking piece connecting hook may also comprise a hook end extending generally perpendicularly to the locking piece longitudinal axis and a hook projection extending in a direction opposite the hook end, and wherein during assembly the connecting hook is inserted into the connecting aperture with the longitudinal axis of the button at an angle with the longitudinal axis of the locking piece. An outward end of the button is pivoted with respect to the locking piece so that the angle between the button axis and locking piece axis decreases, until an inward side of the hook projection contacts an edge of the button aperture, and the lock button and locking piece are moved into longitudinal alignment, and after assembly the hook end and the hook projection are held in place within the lock button aperture. The button aperture may be sized such that there is an interference when the hook projection is pivoted to contact the edge of the button aperture and during installation the hook projection moves beyond the aperture edge and snaps into place within the button aperture.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

In describing the embodiment(s) of the present invention, reference will be made herein to FIGS. 1-7 of the drawings in which like numerals refer to like features of the invention.

Figure 1:
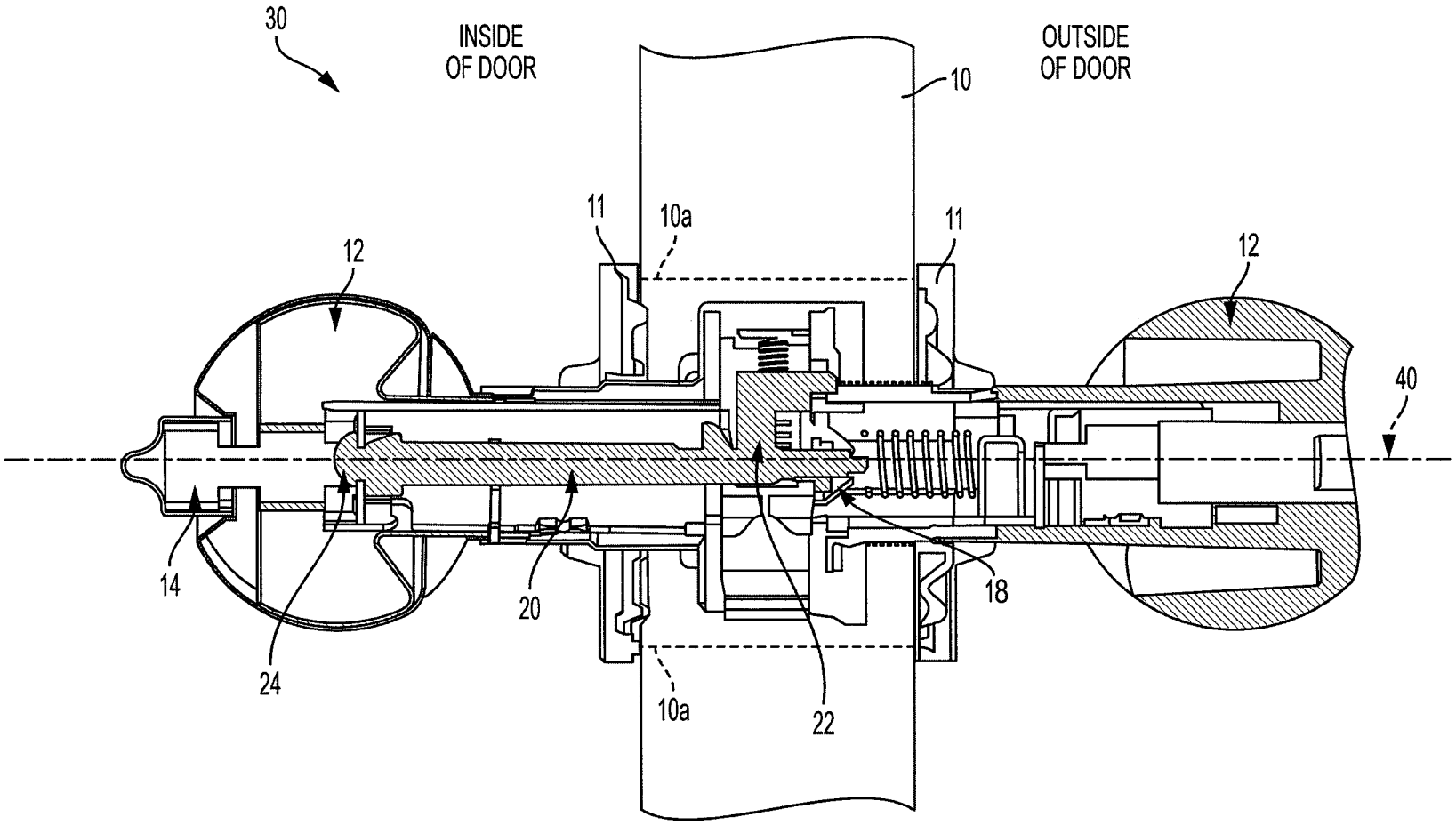
FIG. 1 is a cross-sectional view of a cylindrical lock with doorknobs incorporating the locking piece and lock button assembly of the present invention.
Figure 2:
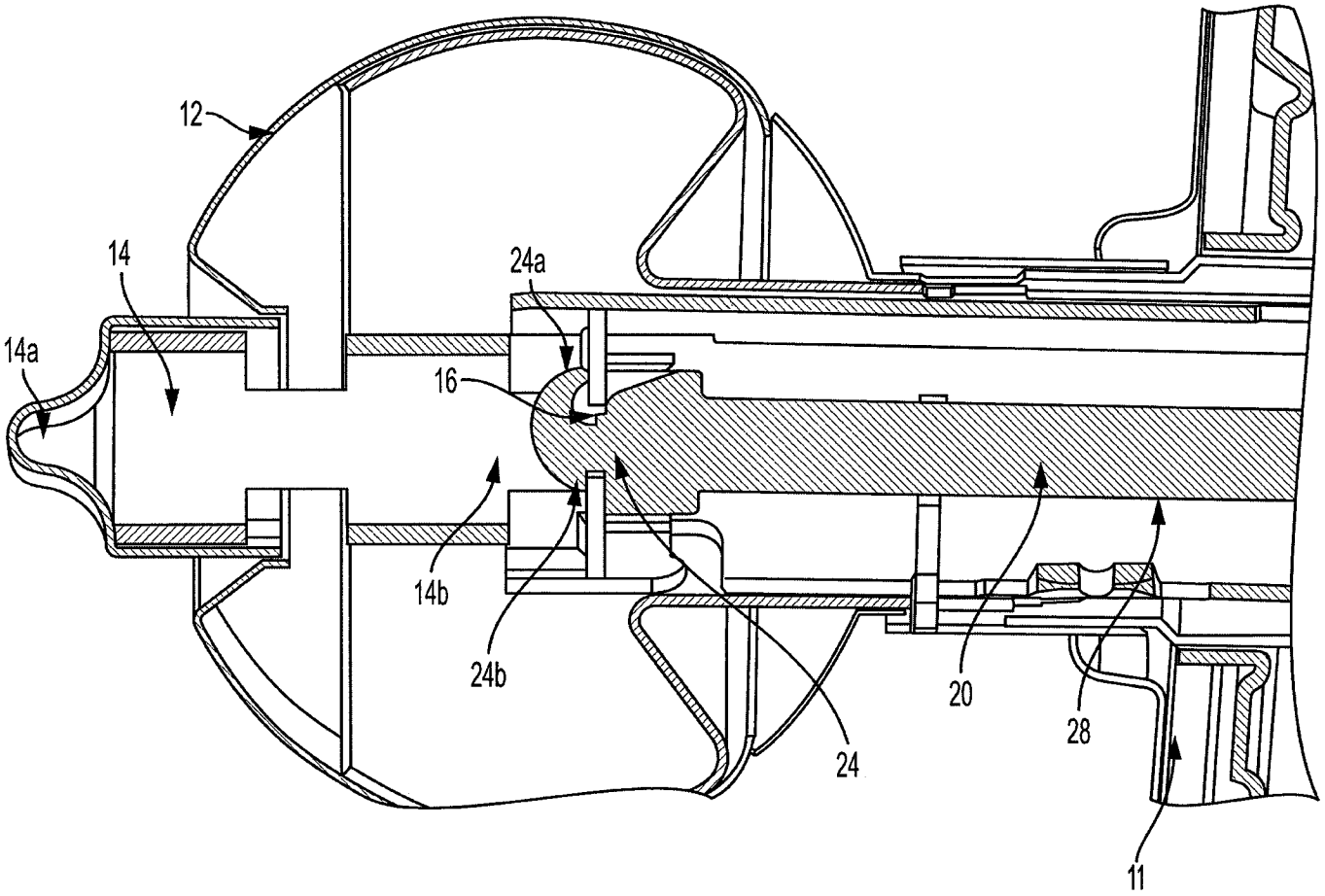
FIG. 2 is a close-up cross-sectional view of the locking piece and lock button connection of FIG. 1.

The present invention is directed to an improved locking piece assembly adapted for installation in a bored tubular or cylindrical lock for installation in bored or otherwise formed circular openings in doors. The locking piece is attached to a button that is depressed or otherwise moved by the user, and moves the locking piece, e.g., inwardly to engage and lock the latch bolt locking mechanism in the bored, tubular or cylindrical lock. Referring to FIGS. 1 and 2, an otherwise conventional bored, tubular or cylindrical lock 30 is mounted in opening 10*a* of door 10, and has doorknob or door handles 12 at opposite ends, and between them escutcheons 11 that abut the door surfaces on opposite sides of opening 10*a*. Locking piece 20 is positioned in doorknob 12 on the inside of the door, and extends into the central portion of the lock 30, with the body 28 of locking piece 20 being aligned with or parallel to longitudinal axis 40 of the cylindrical lock 30.

Locking piece 20 connects lock button 14, extending from doorknob 12, to the latch bolt locking mechanism 18 within cylindrical lock and may be made from an elongated strip, such as stamped steel or other suitable material. A first, forked end 22 of the locking piece 20 is positioned in the central portion of the lock assembly, between escutcheon plates 11. As more clearly shown in FIG. 4, forked end 22 comprises a first prong 22*a* extending parallel from the main body 28, and a second prong 22*b* which branches out perpendicular to the top planar edge of the first prong 22*a*, and then extends at a 90-degree angle parallel to the first prong 22*a*. The first prong 22*a* includes a narrowed-in projection 22*c* jutting from the main body of the first prong 22*a*. A fin 26 protrudes from the top vertical edge of the locking piece body 28, adjacent to the converging point of the first prong 22*a* and second prong 22*b* of the forked end 22. This inward portion 22 of locking piece 20 is otherwise conventional, and engages a conventional mechanism within cylindrical lock to lock the latch.

Figure 3:
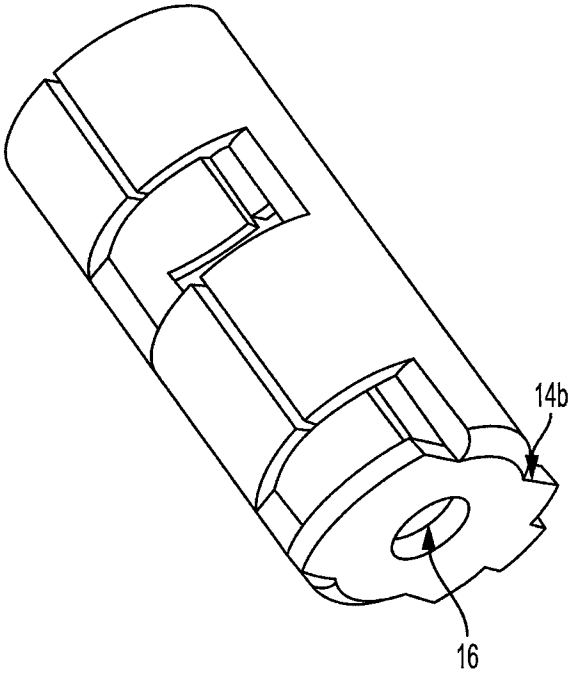
FIG. 3 is a perspective view of the body of the lock button and its connecting aperture for the locking piece of FIG. 1.
Figure 4:
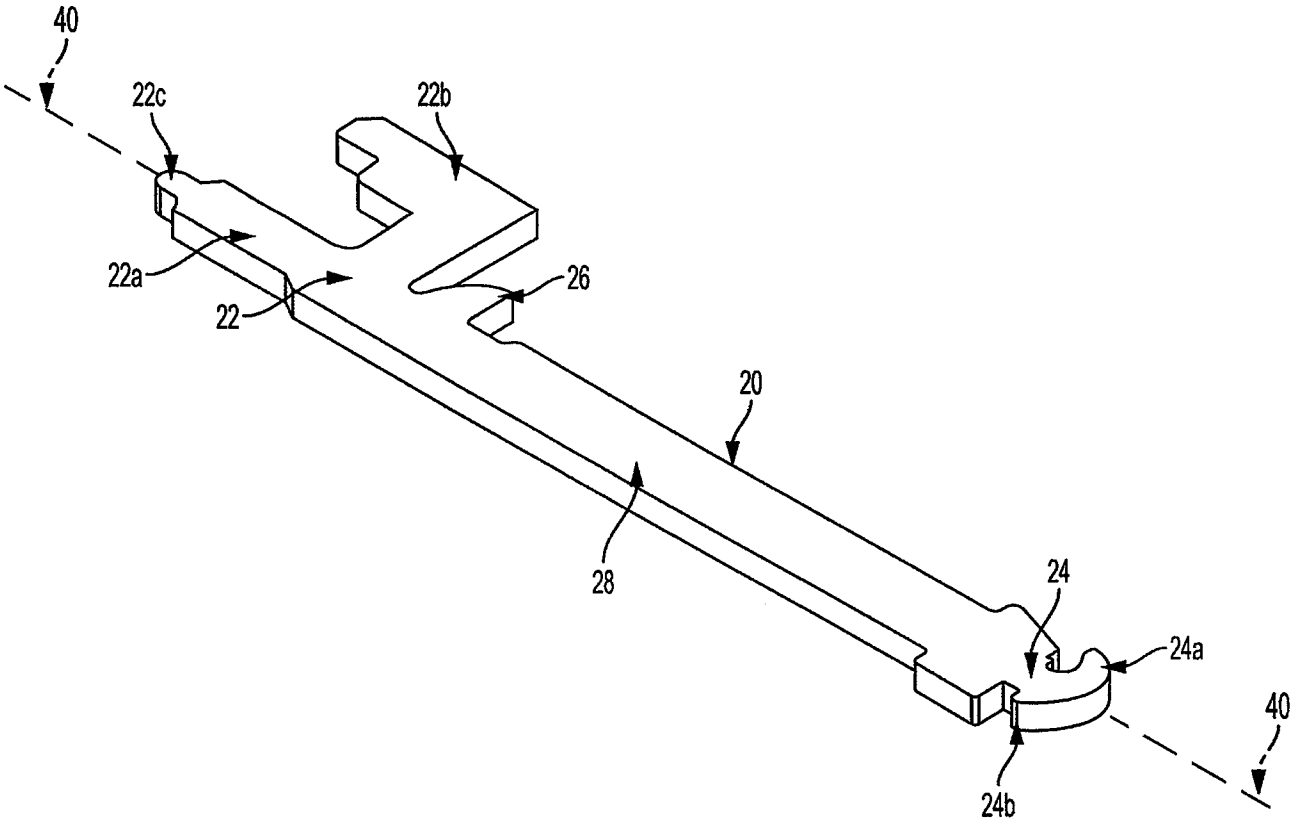
FIG. 4 is a perspective view of the locking piece of FIG. 1.
Figure 5:
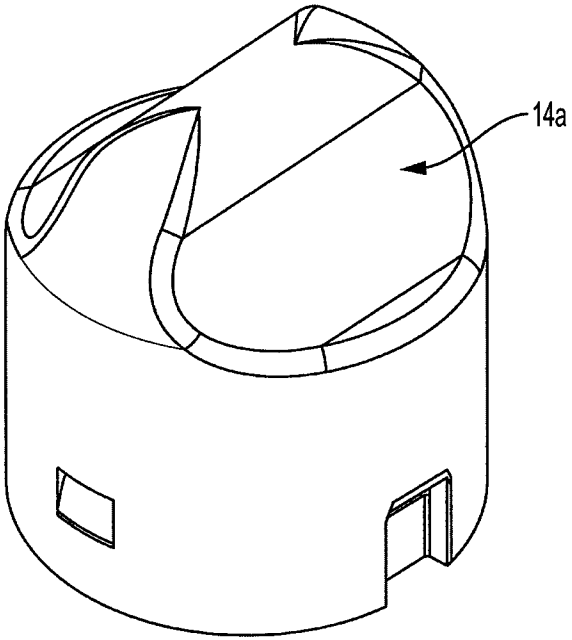
FIG. 5 is a perspective view of the knob end of the lock button of FIG. 1.
Figure 6:
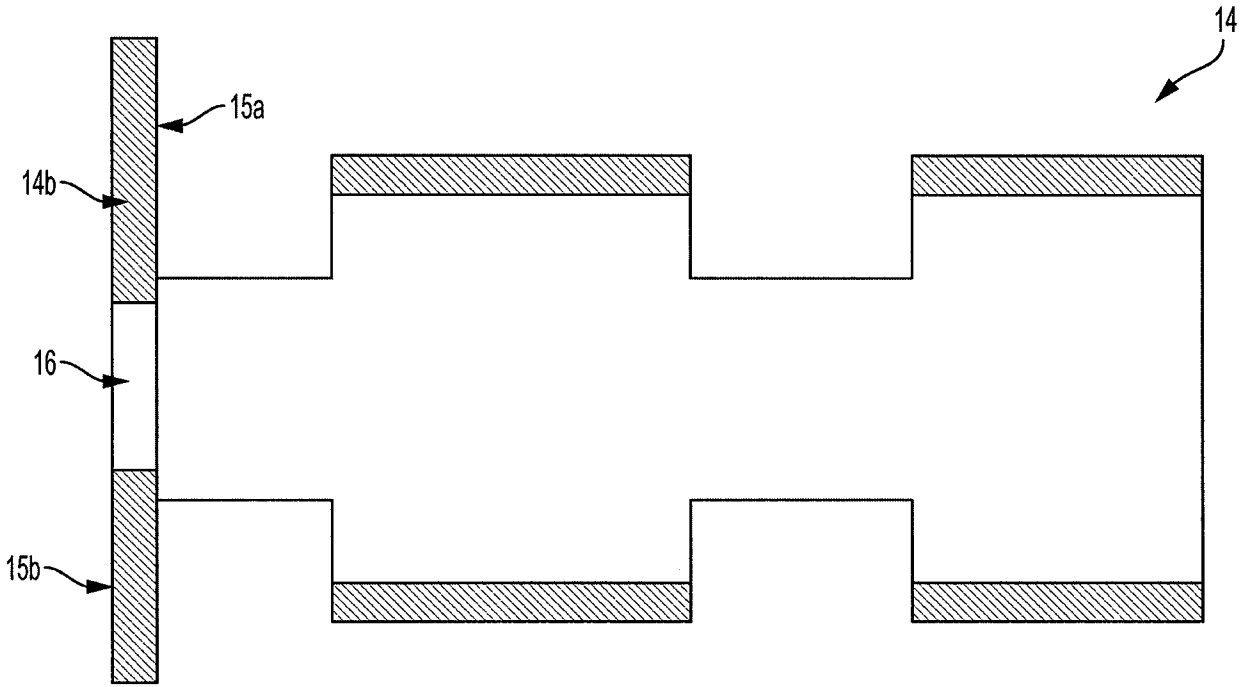
FIG. 6 is a cross-sectional view of the lock button of FIG. 3.
Figure 7A:
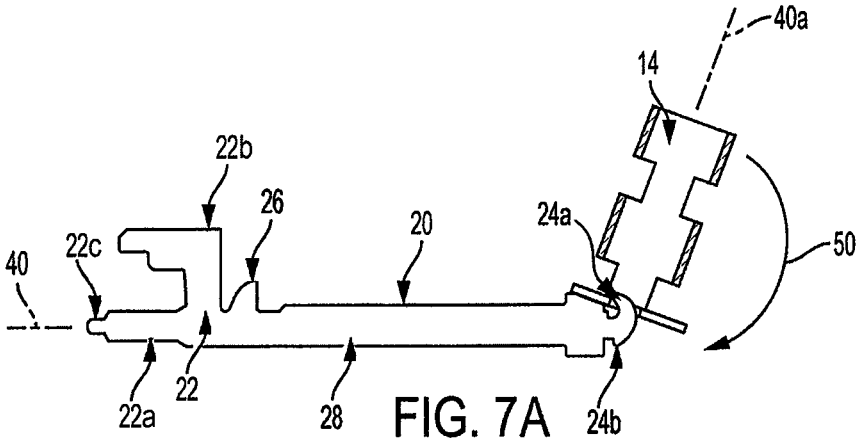
FIGS. 7A-7D is a sequence of side elevational views depicting the method of installing the locking piece of the present invention onto a lock button of the present invention.
Figure 7B:
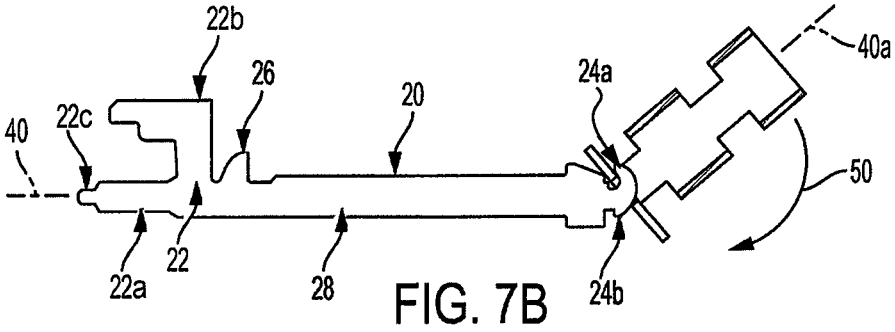
Figure 7C:
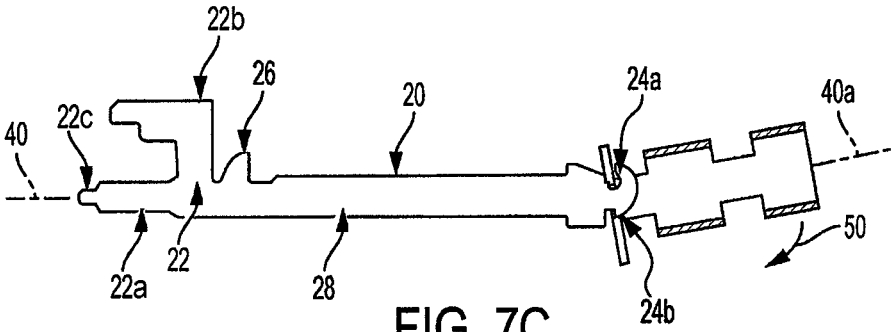
Figure 7D:
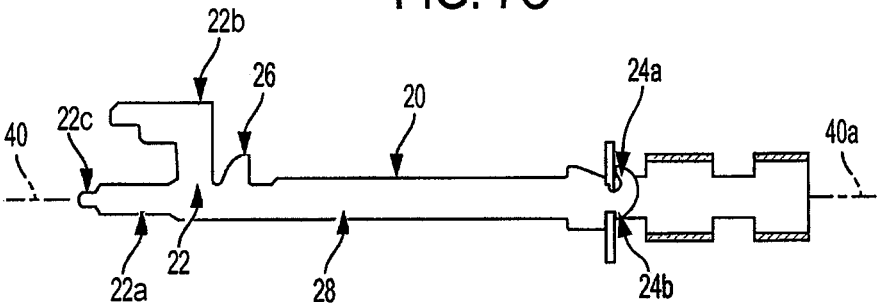

The second end of locking piece 20, opposite from the first, forked end 22, comprises a connecting hook 24 configured in accordance with the present invention. The embodiment of connecting hook 24 as shown has a hook end 24*a* extending generally perpendicularly to longitudinal axis 40 and a hook projection 24*b* which extends or flanges out in the direction opposite the hook end 24*a*. This structure is used to create the connection between the locking piece 20 and a lock button 14 of doorknob 12. Referring to FIGS. 3 and 6, the locking piece 20 connects to the lock button 14 by means of a connecting aperture 16 located on an inward or connecting end 14*b* of the lock button 14. Aperture 16 is shown as being circular, but may have different configurations, for example, a slot of width sufficient to accept the thickness of locking piece hook 24. In the fully assembled position shown in FIGS. 1 and 2, both hook end 24*a* and hook projection 24*b* are captured within aperture 16 on the inward end of lock button 14.

The sequence of the method of assembly of the embodiment of the locking piece 20 depicted to lock button 14 is shown in FIG. 7. Initially, the connecting hook 24 is inserted into the connecting aperture 16 of the lock button 14 in a semi-circular motion 50, as depicted in FIG. 7A, where the longitudinal axis 40*a* of button 14 is at an angle with the longitudinal axis 40 of locking piece 20. The outward end of button 14 is then pivoted or rotated downward with respect to the locking piece, as shown in FIG. 7B, so that the angle between button axis 40*a* and locking piece axis 40 decreases, until the inward side of hook projection 24*b* contacts the edge of button aperture 16 at the lower end, as shown in FIG. 7C. The aperture 16 may be sized such that there is a slight interference when the hook projection 24*b* is pivoted to contact the edge of the aperture 16 on the outside face 15*b* of lock button connecting end 14*b* (FIGS. 3 and 6). By urging and/or forcing the lock button 14 and locking piece 20 into longitudinal alignment along axis 40, the hook projection 24*b* moves beyond the aperture 16 edge and snaps into place on an inside face 15*a* of the aperture 16 on button end 14*b*, as shown in FIG. 7D and FIG. 2. This process to attach the locking piece to the lock button may be done by hand, thus eliminating the need for a machine to assemble the locking piece 20 to the lock button 14. Pushing forces imposed upon the locking piece 20 as the connecting hook 24 is inserted into aperture 16 will allow the connecting hook 24 to pass through the aperture and rest inside the lock button 14. The conjoined locking piece 20 and lock button 14 may then be installed in cylindrical lock 30 by otherwise conventional methods, and the lock button may be moved to engage or disengage a conventional locking mechanism of the lock.

The dimensions of hook end 24*a* and hook projection 24*b* may serve as a barrier to prevent removal of the locking piece 20 from the aperture 16 of the lock button after attachment to the lock button. More specifically, the stepped-in edge of hook projection 24*b* makes it more difficult to easily separate the lock button 14 and the connecting hook 24, and provides for a permanent connection during normal operation of the locking mechanism. Additionally, the locking piece 20 is held in a non-rotatable position after the locking piece assembly is installed into the cylindrical lock, before or after the lock is installed in the bored opening of the door 10. The lock button 14 is still capable of rotating around axis 40 and the connecting hook 24 of the locking piece 20 after the installation, by means of rotating a button knob end 14*a* (FIGS. 2 and 5) by hand. Action by the user to move lock button 14 allows for engagement and disengagement of a locking mechanism 18 within the cylindrical lock 30.

Thus, the present invention provides a complimentary locking piece and button apparatus, and method of assembly, that requires a minimal number of parts, is inexpensive, and may be done without the aid of a machine.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A locking piece assembly adapted for installation in a cylindrical lock to engage a locking mechanism upon movement of the cylindrical lock, the locking piece assembly comprising:

a locking piece comprising an elongated member having one end adapted to engage the locking mechanism, an opposite end having a connecting hook, and a longitudinal axis extending along the elongated member through the one end and the opposite end, said connecting hook comprising a hook end extending generally perpendicular to the longitudinal axis and said hook comprising a hook projection extending perpendicular to the longitudinal axis in a direction opposite the hook end; and a lock button having an aperture, said lock button adapted to pivotally receive the locking piece connecting hook by hand such that, during installation and assembly of the locking piece assembly, the hook end and the hook projection are captured within said aperture on an inward end of the lock button by an outward end of the lock button being pivoted or rotated downward with respect to the lock piece until an end of the button is fittingly engaged with the hook end and hook proiection, respectively, such that the lock button being able to be depressed to move the locking piece inward to engage and lock the locking mechanism after installation in the cylindrical lock;

wherein the hook end and hook projection contact an inside face of the aperture upon capture to prevent removal of the locking piece from the aperture of the lock button, and wherein a longitudinal axis of the lock button is aligned with the longitudinal axis of the locking piece upon capture.

2. The locking piece assembly of claim 1 wherein the locking piece is held in place and permits rotational movement of the lock button around the longitudinal axis.

3. A cylindrical lock comprising:

a locking mechanism;

a locking piece comprising an elongated member having one end engaging the locking mechanism, an opposite end having a connecting hook, and a longitudinal axis extending along the elongated member through the one end and the opposite end, said connecting hook comprising a hook end extending generally perpendicular to the longitudinal axis and said connecting hook comprising a hook projection extending perpendicular to the longitudinal axis in a direction opposite the hook end; and a lock button extending from a knob of the cylindrical lock and having an aperture at an inward end thereof, said lock button adapted to pivotally receive the locking piece connecting hook, the locking piece connecting hook adapted to being attached by hand to the lock button aperture such that during installation and assembly of the cylindrical lock, the hook end and the hook projection are captured within the lock button aperture on an inward end of the lock button by an outward end of the lock button being pivoted or rotated downward with respect to the locking piece until an end of the button is fittingly engaged with the hook end and hook projection, respectively, such that the lock button being able to move the locking piece to engage and lock the locking mechanism, wherein rotational movement of said lock button around the longitudinal axis is permitted after the hook end and hook projection are captured within the lock button aperture;

wherein the hook end and hook projection contact an inside face of the aperture upon capture to prevent removal of the locking piece from the aperture of the lock button.

4. The cylindrical lock of claim 3 wherein the longitudinal axis of the locking piece is in longitudinal alignment with a longitudinal axis of the lock button after the hook end and hook projection captured within the lock button aperture.

5. A method of making a locking piece assembly adapted for installation in a cylindrical lock to engage a locking mechanism upon movement of the cylindrical lock comprising:

providing a locking piece comprising an elongated member having one end adapted to engage a locking mechanism, an opposite end having a connecting hook, and a longitudinal axis extending along the elongated member through the one end and the opposite end, said connecting hook comprising a hook end extending generally perpendicular to a longitudinal axis of the locking piece and said connecting hook comprising a hook projection extending perpendicular to the longitudinal axis in a direction opposite the hook end;

providing a lock button having a first end including an aperture, a second end opposite the aperture, and a length therebetween, said lock button aperture adapted to be attached to the locking piece connecting hook by hand such that during installation and assembly of the locking piece assembly the hook end and the hook projection are captured within said aperture on an inward end of the lock button, such that the lock button being able to be depressed to move the locking piece inward to engage and lock the locking mechanism after assembly;

attaching the lock button by hand onto the locking piece by inserting the hook end into the aperture on the lock button;

pivoting said second end of the lock button with respect to the locking piece longitudinal axis; and placing the locking piece longitudinal axis and the length of the lock button into alignment such that said first end of the button is fittingly engaged with the hook end and hook projection, respectively, and the hook end and the hook projection contact an inside face of the aperture to prevent removal of the locking piece from the aperture of the lock button.

6. The method of claim 5 wherein the step of attaching the lock button further comprises inserting the hook end into the aperture at an angle with respect to the length of the button, pivoting the second end of the button with respect to the locking piece so that the angle decreases until said hook end and said hook projection contact an inside face of the aperture and prevent removal of the locking piece from the aperture of the lock button.

7. The method of claim 5 wherein the button aperture is sized such that there is an interference when the hook projection contacts the inward end of the button aperture and the hook end and projection are captured within said aperture on the inward end of the lock button.

8. A method of manufacturing a cylindrical lock comprising:

providing a locking mechanism;

providing a locking piece comprising an elongated member having one end adapted to engage the locking mechanism, an opposite end having a connecting hook, and a longitudinal axis extending along the elongated member through the one end and the opposite end, said connecting hook comprising a hook end extending generally perpendicular to the longitudinal axis and said connecting hook comprising a hook projection extending perpendicular to the longitudinal axis in a direction opposite the hook end;

providing a lock button extending from a knob of the cylindrical lock, said lock button having a first end having an aperture, a second end opposite said aperture, and a length therebetween, said aperture at an inward end of the knob, said lock button adapted to pivotally receive the locking piece connecting hook by hand;

attaching the lock button to the locking piece by inserting the hook end into the aperture on the lock button;

pivoting said second end of the lock button with respect to the locking piece length; and placing the locking piece longitudinal axis and lock button length into alignment to make a locking piece assembly wherein the first end of the lock button is fittingly engaged with the hook end and hook projection, respectively, and the hook end and the hook projection contact an inside face of the aperture, and prevent removal of the locking piece from the aperture of the lock button; and installing the locking piece assembly into the cylindrical lock whereby the lock button extends from the knob of the cylindrical lock and the locking piece one end engages the locking mechanism of the cylindrical lock, the locking piece held in place and permitting rotational movement of the lock button around the longitudinal axis, and whereby the lock button being able to move the locking piece to engage and lock the locking mechanism.

9. The method of claim 8 wherein the step of attaching the lock button further comprise inserting the hook end into the lock button aperture at an angle with respect to the length of the button, pivoting the second end of the lock button with respect to the locking piece so that the angle decreases until the hook end and hook projection contact an inside face of the aperture.

10. The method of claim 8 wherein the button aperture is sized such that there is an interference when the hook projection contacts the inward end of the lock button aperture and the hook end and hook projection are captured within said aperture on said inward end of the lock button.

* * * * *